United States Patent [19]

Blanchfield

[11] 3,940,308

[45] Feb. 24, 1976

[54] SUCTION PIPE WITH QUICK DISCONNECT COVER

[75] Inventor: Phillip E. Blanchfield, Hortonville, Wis.

[73] Assignee: Appleton Specialty Products Inc., Appleton, Wis.

[22] Filed: June 7, 1974

[21] Appl. No.: 477,453

[52] U.S. Cl. ..... 162/363; 138/92; 162/374

[51] Int. Cl.[2] ..... D21F 1/48

[58] Field of Search ..... 162/363, 374, 199, 274, 162/279, 366, 364; 15/306 R, 306 A, 308; 138/92

[56] References Cited

UNITED STATES PATENTS

| | | | |
|---|---|---|---|
| 751,095 | 2/1904 | McAnulty et al. | 162/374 |
| 1,279,170 | 9/1918 | Sullivan | 162/374 X |
| 1,534,854 | 4/1925 | Lewis | 162/374 |
| 3,067,816 | 12/1962 | Gould | 162/374 |
| 3,218,228 | 11/1965 | Wagenknecht | 162/374 X |
| 3,365,359 | 1/1968 | Proulx | 162/363 X |

FOREIGN PATENTS OR APPLICATIONS

| | | | |
|---|---|---|---|
| 770,832 | 3/1957 | United Kingdom | 162/374 |

OTHER PUBLICATIONS

*Pulp and Paper Magazine of Canada*, May 1966, p. 26.

*Primary Examiner*—S. Leon Bashore
*Assistant Examiner*—Marc L. Caroff
*Attorney, Agent, or Firm*—James J. Getchius

[57] ABSTRACT

A suction pipe for a paper machine having a tapered seat and a cover and an insert mounted in the seat to provide an air tight seal therewith. The insert and the cover being laterally removable from the seat after sufficient longitudinal travel of the cover to free the insert in the seat.

6 Claims, 4 Drawing Figures

SUCTION PIPE WITH QUICK DISCONNECT COVER

BACKGROUND OF THE INVENTION

1. Field of the Invention

This invention pertains to suction pipes for paper machines.

2. Description of the Prior Art

The conventional suction pipe has a cover with a tapered seat, which extends substantially the length of the pipe. A pair of elements having a complementary configuration, secure the cover to the pipe by a plurality of capscrews to form an airtight connection therewith. The pipe may be mounted in a press section after the press rolls. Water forced into the felt is drawn therefrom into the pipe by the vacuum existing in the pipe. To be effective, the cover and the felt passing thereover, must also provide an effective seal. Any wear grooves in the cover would allow air into the suction box and thus prevent the vacuum from accomplishing its main purpose of extracting water from the felt. As a consequence it is frequently necessary to remove the cover from the suction pipe and refinish or replace same. Inasmuch as a conventional suction pipe cover is secured to the pipe by a pair of elements attached by capscrews to the pipe, the entire pipe is usually removed from the machine. Also, frequently the pipe itself is mounted within the frames of the machine, thus when a tapered seat is relied on exclusively to maintain the cover in the seat, as in a suction box or suction pipe, the entire pipe rather than the cover alone must be removed from the machine. Where the paper machine frame is not a problem, as in the top felt, removing the cover alone longitudinally out of the suction pipe seat is difficult as some sort of crane means is needed due to the height of about 20 ft. from the floor, and the length of the cover, which is slightly wider than the paper width.

SUMMARY OF THE INVENTION

Applicant's apparatus is designed to provide for quick disassembly and assembly of the cover from the suction pipe without removal of the pipe from the paper machine, thereby reducing down-time of the machine. The machine, however, is not operating when the cover is being changed. Due to the use of new type synthetic felts (nylon), high machine speeds of 2000 ft. per minute, and the use of polyethylene or the like covers, cover changing is also more frequent than in the past which further accentuates the need for a quick disconnect cover.

Specifically, Applicant has provided a pipe with a tapered seat which preferably may have a dove tail configuration. A cover having a similar tapered configuration is designed to be mounted in the seat along with an insert. The number of inserts used depends on the length of the pipe. The insert is preferably not tapered and is a relatively flexible strip of a material unlike that of the cover. The seat, cover, and insert are so dimensioned that when the entire pipe assembly is in position in the paper machine, tapping the cover and moving same approximately 4 inches in the opposite direction of the taper, will free the insert or inserts depending upon the number used. The insert or inserts may then be removed laterally from the seat. A chain supports same from the pipe when not in the seat. The cover can now be rotated and moved laterally from the seat rather than longitudinally. Hence, where the pipe is mounted between the frames, the cover is nevertheless removable therefrom. Due to its weight of approximately 40 lbs. for a 200 in. cover, the movement of the cover to clear the seat is not a difficult procedure, The cover can now be resurfaced or replaced and then quickly reassembled to the pipe in a procedure opposite to that for removal.

It is, therefore, an object of this invention to provide a new and improved suction pipe for a paper machine with a quick disconnect cover.

Another object of this invention is to provide a quick disconnect cover that can be assembled or disassembled to a suction pipe by lateral movement into or out of the tapered seat of the suction pipe.

DESCRIPTION OF THE PREFERRED EMBODIMENT

Figure 1:
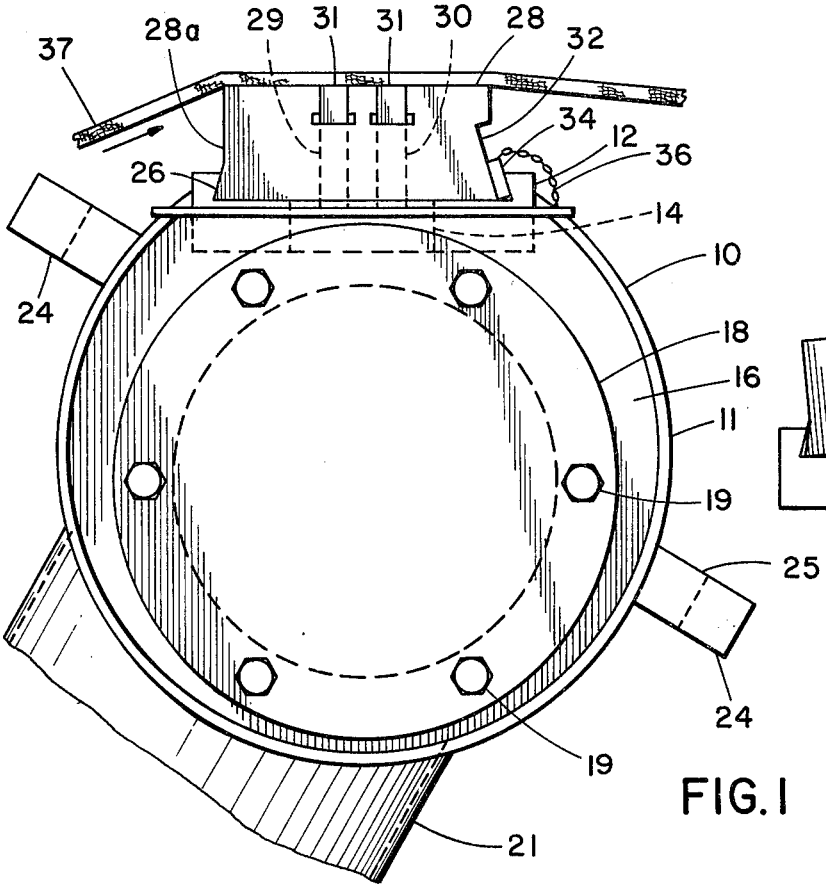
FIG. 1 is an end view of the tending side of the suction pipe of this invention.
Figure 2:
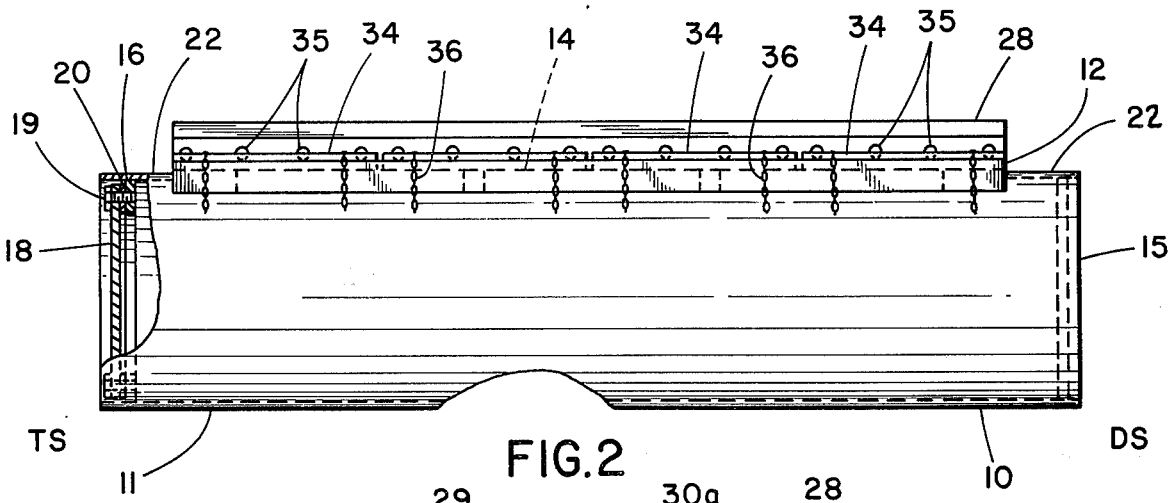
FIG. 2 is a side view (partially cut away) of the pipe.

Referring to FIGS. 1 and 2, 10 indicates generally the suction pipe of this invention. Pipe 10 includes pipe section 11 which may be made of stainless steel. Section 11 has an open top which is closed by welding a longitudinally extending stainless steel bar 12 thereto. Bar 12 has a plurality of spaced and aligned slots 14 extending therethrough and providing communication with the interior of the pipe section 11. The drive end of the pipe section 11 is closed by rear closure 15 which may be welded thereto. The tending side end of the pipe section 11 has a flange 16 formed by welding a hollow disc to the interior of the pipe section 11. Front closure 18 is attached to flange 16 by capscrews 19 with gasket 20 therebetween. Closure 18 provides clean out access to the section 11. Also extending from the bottom of section 11 is exit conduit 21 which is adapted to be connected to a source of vacuum. Plates 22, at both ends of section 11, are welded thereto and to bar 12 to close off the section 11. Suitable brackets 24 are welded at both ends of section 11 and have grooves 25 for mounting the section to the frames of a paper machine.

Bar 12 has machined therein a female dovetail seat 26. Seat 26 is tapered to a smaller dimension at the driving end than at the tending end. The taper is uniform and on both sides of the dovetail.

Figure 3:
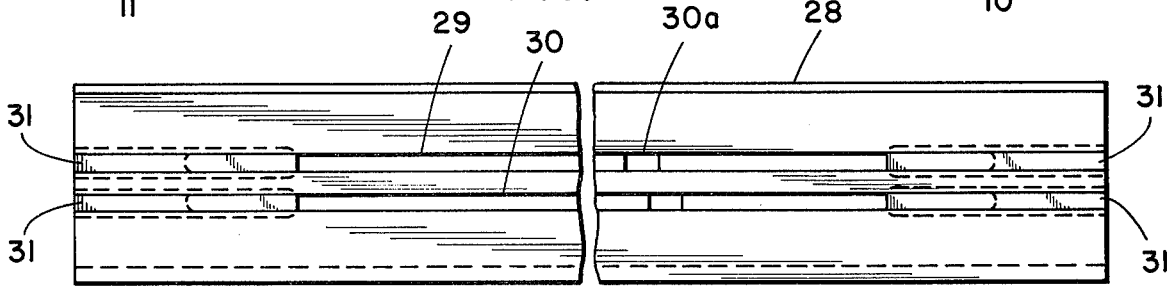
FIG. 3 is a plan view of the cover for the pipe.

Mounted in seat 26 is cover 28. Cover 28 which may be made of polyethylene has a male dovetail 28a which is tapered to complement seat 26. Cover 28 as shown in FIG. 1 and FIG. 3 has slotted passages 29 and 30 which extend through the cover and are in communication with slots 14 of bar 12 for conducting liquid into the pipe 10. Suitable spaced reinforcements 30a may be provided along the length of passages 29 and 30 to strengthen cover 28. Standard deckle blocks 31, are located at each end of the cover adjacent to the passages 29 and 30 and adjust inward for felt trimming. Cover 28 also has a longitudinally extending surface 32 for a purpose to be described later.

Mounted in the female dovetail seat 26 of bar 12 are a plurality of inserts 34 (FIGS. 1 and 2) which may be made of stainless steel. The number of inserts used depends on the length of cover 28. Each insert is preferably a strip of rectangular and uniform crossection. The strip or insert is intended to fit tightly between one side of the female dovetail seat 26 and the surface 32 of the cover 28. Each insert has a plurality of spaced holes 35 therethrough. The holes are accessible from the top when the insert 34 is in seat 26. A plurality of chain lengths 36 at each end of an insert are welded thereto and to section 11. The chains 36 support the inserts when they are out of the seat 26.

As shown in FIG. 1, with cover 28 and inserts 34 mounted in seat 26, tapping cover 28 at the tending side will force the cover and insert toward the driving side to tightly wedge same in seat 26 providing an airtight connection therewith. Any vacuum applied to section 11 therefore will draw water through the felt passing over cover 28 through slotted passages 29 and 30 therein and through slots 14 in bar 12 into the interior of pipe 10. Of course, cover 28 and the felt 37 in moving contact therewith must fit smoothly. As mentioned previously, if there are wear grooves in the top of cover 28, air can move therethrough and into the pipe section 11 defeating the goal of drawing the water from the felt.

Because the covers must be resurfaced or replaced frequently to remove the wear grooves noted and thus to maintain pipe suction, Applicant's structure detailed above is designed to provide a quick disconnect of the cover 28 from the pipe section 11 and reassembly of same without removal of the pipe 10 from the machine. Also, if the pipe 10 is not mounted on a paper machine, the time of assembly and disassembly of the cover to section 11 is still reduced.

To achieve the quick disconnect feature, Applicant designed the noted structure so that the cover 28 can be removed essentially laterally from seat 26 rather than by the conventional complete longitudinal withdrawal. Applicant calculated that 4 inches of longitudinal movement of the cover 28 from the driving side toward the tending side was permissible before same would contact a paper machine frame. Therefore, the cover 28 must be withdrawable from seat 26 at this point. Since a female and male dovetail arrangement are preferred for stability, one or more inserts are required to provide the joint and still be removable so that the cover in turn can then be removed from the seat. Because of the tapered seat and cover construction, and the above noted limitations, the dimensions utilized had to be calculated with care.

Applicant commenced the calculations by selecting a cover and therefore female seat longitudinal dimension of 200 inches. Applicant also selected a taper for the seat of 0.625 inch or 0.003125 inch per inch of taper. The taper is the same for both sides of the seat. Thus in 4 inches from the end of the driving side, the seat is 4 × 0.00312 inch or 0.0125 inch larger.

In calculating the female dovetail seat dimensions, Applicant selected a dovetail angle of 75° and a width of 5¼ inches across the bottom of the edges. Applicant also selected the height of the seat as 0.50 inches and the diameter of the measuring pins at 0.250 inch. Thus the dimension $y$ across the measuring pins (which are located in the edges of the grooves) is obtained from formula $y = b - D\ (1 + \text{Cot}\ \alpha/2)$ or $y = 5\frac{1}{4}$ inches − 0.25 ( 1 + 1.3032 ) = 4.675 inches. This dimension is for the tending side and allowing for the noted taper, the dimension at the driving side is 4.050 inches with a 0 to 0.002 inch tolerance. The noted formula can be found in Machinery's Handbook by Oberg and Jones. Calculating the horizontal "C" dimension or 0.1339 inch from the bottom corner to the top of the dovetail edge resulted in a dimension of 4.982 inches at the tending side across the edges noted, and 0.625 inch less or 4.357 inches at the driving side. These dimensions are important as the cover must be removable therethrough.

Applicant selected as an insert a rectangular cross section of ¼ × ¾ × 49¾ inches long with the cross sectional dimensions closely held. The insert is intended to be placed in the seat on the right side thereof while facing the tending side. The dimensions of the reduced female dovetail seat had to be then determined because of the presence therein of the insert. By trigonometry, the new dimension over the corners as calculated is 5 inches instead of 5¼ inches and over the pins is 4.4242 inches using the aforementioned formula. These dimensions, of course, are for the tending side and are reduced 0.625 inch for the driving side.

With the above information, Applicant calculated the dimensions of the male dovetail configuration of the cover. Utilizing the 5.00 inch dimension above and the "C" (0.1339) dimension, Applicant calculated the "A" dimension across the corners, which corresponds to the top of the female dovetail in configuration only, and found same to be 4.7322 inches. Then from a formula in Mathematics For Industry 1958 Edition by S. E. Rusinoff, the dimension across the pins for the male dovetail was calculated. It is to be noted that the male dovetail is measured on a flat surface. The formula used is $A\ 1 = (D/2)\ \text{Cot}\ \alpha/2$ in which $D$ is the diameter of the pin (0.25 inch) and $\alpha = 105°$. $A\ 1$ is the same on both sides of the dovetail. The dimension, therefore across the pins, is $X = A\ 1 + A1 + D + 5.00$ inches where 5.00 inches is across the corners of modified female dovetail and utilized for the dimension across the cover corners. $X$ calculated to be 5.440 inches at the tending side and 4.815 inches at the driving side.

To demonstrate that the dismantling of insert and cover from the seat of the pipe can be achieved under the conditions desired can be disclosed as noted below. With the cover 28, insert 34 wedged into position in seat 26 and thus operative as shown in FIG. 1. Applicant, to remove the cover, taps the cover at the drive side and moves the cover four inches toward the tending side. The insert remains in position due to its length of approximately 50 inches. At four inches from the end of the drive side seat, the seat therefore is 0.012 inch larger than the reduced size cover. This clearance extends all along the balance of the seat. Applicant, then inserts a screwdriver into holes 35 in the insert and in effect moves the cover against the seat side opposite to the insert to get the noted 0.012 inch clearance therebetween and pries the insert or inserts out of the seat. The insert or inserts are held in a stored position by chains 36. The 0.012 inch clearance has proved to be adequate for the purpose of removing inserts.

Applicant is now ready to remove cover 28 which also moved four inches from the drive side.

Figure 4:
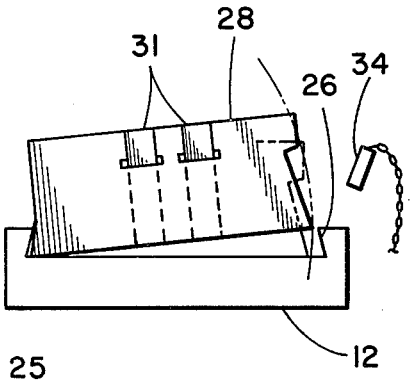
FIG. 4 is a view, similar to FIG. 1, with the cover in the process of being removed from the pipe.

Inasmuch as seat 26 has a dimension at the tending side of 4.982 inches and 4.357 inches (drive side) across the corners at the top of the seat and the cover has a 5.000 inches and 4.375 at the lower corners, even with the taper at four inches, the cover cannot be lifted straight out of seat 26. Thus, Applicant, as shown in FIG. 4, pivots the cover out of the seat 26 by using the top corner as a fulcrum (on the side opposite the insert) and rotates the cover laterally out of the seat. This can be done with the cover full in the seat or preferrably withdrawn the four inches noted dimension. This is true because at four inches from the driving side the dimension at the top corners is 4.357 inches + 0.0125 = 4.369 inches and the radius at the cover calculates to be 4.27 inches. At the end of the seat (tending side) where the dimension is 4.982 inches, the cover radius after considering the taper is 4.875 inches.

Thus, Applicant, by careful calculations and control of tolerances, has achieved his purpose of lateral and faster removal of the cover from the seat which can be accomplished by assigning an operator to each end of the 40 lb cover to remove same as shown in FIG. 4. Reinstalling the cover to the seat requires the prior lateral insertion of the cover into the seat, the replacing of the insert and the driving of the cover four inches toward the drive side to tighten same in the seat. Suitable means (not shown) can be provided to lock the cover in the seat.

Having thus described the preferred embodiment of the invention, it is to be understood that same is not limited to the specific form disclosed, but covers all modifications, changes and alternative constructions falling within the scope of the principles taught by the invention.

I claim:

1. A suction pipe for a paper machine comprising:

a. a pipe adapted to be connected to a vacuum means, said pipe having a longitudinally extending dovetail seat that is tapered in the longitudinal direction from one end of the seat to the other and slots therethrough extending into the interior of said pipe;

b. a cover having a tapered configuration complementary to the tapered configuration of said seat and mounted in said seat, said cover having passages therethrough aligned with said slots for conducting a liquid into said pipe; and c. an insert located between said cover and said pipe in said seat and providing an air tight seal with said pipe and cover, said insert having a portion extending above said seat, said insert being laterally removable from said seat upon longitudinal movement of said cover in said seat away from said air tight position to free said insert, said cover thereby being laterally removable from said seat.

2. The pipe of claim 1 in which said insert portion has means engageable by motive means for removing said insert from said seat.

3. The pipe of claim 2 in which said means engageable by motive means is a plurality of spaced holes.

4. The pipe of claim 3 in which said cover has a surface adjacent to said insert which extends above said insert to provide clearance for the removal of said insert from said seat and said insert is a metallic flexible strip.

5. The pipe of claim 4 in which said insert comprises a plurality of segments aligned end to end and having a rectangular and longitudinally extending configuration and further comprising means connected to said pipe for supporting said segments when not in said seat.

6. The pipe of claim 5 in which said segments are made of stainless steel and said cover is made of polyethylene and said seat is made of stainless steel.

* * * * *